US007997830B2

(12) United States Patent
Wendt et al.

(10) Patent No.: US 7,997,830 B2
(45) Date of Patent: Aug. 16, 2011

(54) BARRIER WALL MADE OF SHEET-PILE COMPONENTS

(75) Inventors: Rob Wendt, Rapid City, SD (US); Richard Heindl, Munich (DE)

(73) Assignee: Pilepro, LLC, Austin, TX (US)

( * ) Notice: Subject to any disclaimer, the term of this patent is extended or adjusted under 35 U.S.C. 154(b) by 0 days.

(21) Appl. No.: 12/957,534

(22) Filed: Dec. 1, 2010

(65) Prior Publication Data

US 2011/0076103 A1 Mar. 31, 2011

Related U.S. Application Data

(63) Continuation of application No. 11/849,191, filed on Aug. 31, 2007, now abandoned.

(30) Foreign Application Priority Data

Sep. 1, 2006 (DE) ..... 10 2006 041 049

(51) Int. Cl.
*E02D 7/00* (2006.01)

(52) U.S. Cl. ..... 405/279; 405/285

(58) Field of Classification Search ..... 405/274–276, 405/277, 279, 284–286; 52/169.1, 289
See application file for complete search history.

(56) References Cited

U.S. PATENT DOCUMENTS

| | | | | |
|---|---|---|---|---|
| 635,165 | A * | 10/1899 | Weyhe | 405/284 |
| 850,496 | A | 4/1907 | Schugart et al. | |
| 932,261 | A | 8/1909 | Flynn | |
| 2,000,492 | A * | 5/1935 | McKeen | 405/262 |
| 2,769,277 | A * | 11/1956 | Keelor | 47/33 |
| 3,316,721 | A | 5/1967 | Heilig | |
| 3,420,065 | A * | 1/1969 | Holl | 405/284 |
| 3,869,868 | A | 3/1975 | Irsai | |
| 4,836,718 | A | 6/1989 | Deaton | |
| 5,356,242 | A * | 10/1994 | Elmore et al. | 405/262 |
| 6,226,936 | B1 * | 5/2001 | Grossman | 52/169.1 |
| 2005/0163575 | A1 | 7/2005 | Dagher et al. | |
| 2006/0051165 | A1 | 3/2006 | Han | |
| 2006/0153646 | A1 | 7/2006 | Cammack | |
| 2007/0092342 | A1 | 4/2007 | Hartman | |
| 2007/0286688 | A1 | 12/2007 | Bradley | |
| 2008/0279634 | A1 | 11/2008 | Heselden | |
| 2009/0123237 | A1 | 5/2009 | Heindl et al. | |

FOREIGN PATENT DOCUMENTS

JP 11043953 A 2/1999

* cited by examiner

*Primary Examiner* — Tara Mayo-Pinnock

(74) *Attorney, Agent, or Firm* — Karl F. Milde, Jr.; Eckert Seamans Cherin & Mellott, LLC

(57) ABSTRACT

Free standing above-ground barrier wall 10 that includes a plurality of sheet-pile planks 16, and optionally one or more support elements 12 that are interconnected together using one or more interlocking connectors 22, 24. The sheet-pile plank 16 has a lower edge located proximate a top surface of the ground 14 upon which the free standing above-ground barrier wall 10 is erected in an upstanding, installed configuration. The sheet-pile plank 16 and the support element 12 each constitute sheet-pile components and in the upstanding, installed configuration, a lower portion of the sheet-pile plank 16 is ground engaged and a substantial entirety of the weight of the sheet-pile plank is supported at its engagement with the ground. The engagement may be merely abutting with the plank 16 resting atop the ground, or the lower edge of the plank 16 may be buried into the ground to a certain degree.

18 Claims, 5 Drawing Sheets

BARRIER WALL MADE OF SHEET-PILE COMPONENTS

CROSS-REFERENCE TO RELATED APPLICATION

This application is a continuation of U.S. patent application Ser. No. 11/849,191, filed Aug. 31, 2007, entitled "BARRIER WALL MADE OF SHEET-PILE COMPONENTS", now abandoned.

BACKGROUND

The invention concerns a barrier of elongate sheet-pile components including pile planks and connection and support elements that are interconnected with each other to form a barrier wall when locked together.

Rapidly erectable barriers for military purposes, to delimit plots of land and to provide protection from storms such as hurricanes and related storm surges are generally known. Such barriers are most often erected by hand using bags filled with sand or dirt because they can be erected rapidly and deliberately on-site at the area of interest (threatened by storm or requiring delineation). Such barriers can be quickly erected, but generally necessitate high labor costs and the static nature of such barriers, especially when they are used, for example, against hurricanes, is limited at the same time.

SUMMARY

Given this background, it is a goal of the present disclosure to provide a barrier that can be erected quickly, on the one hand, but is characterized by much higher stability in comparison with ordinary barriers, on the other.

According to the invention, for erection of such barriers, the use of sheet-pile components, like pile planks, connection elements for sheet-pile components, so-called profiles, and also support elements, like double T-supports (I-supports) or tube piles, are used. The mentioned sheet-pile components are ordinarily used to erect sheet piles, in which the sheet-pile components are driven into the ground with appropriate equipment, such as rams or vibrators. According to the present invention, such sheet-pile components are now to be joined to each other and arranged relative to one another so that they stand essentially free in the barrier erected from them; i.e., support themselves without falling down, in which case the sheet-pile components are supported essentially vertically with their bottom ends or edges on the surface of the ground.

The erection of substantially above ground barriers from sheet-pile components also has the particular advantage that the relatively short (height-wise) sheet-pile components that can be used are generally not otherwise suitable for traditional uses that require the piles to be deeply rammed or otherwise driven into the ground.

The barriers according to the invention can be used, for example, to delimit plots of land. They are also particularly suited for military purposes, for example, to erect street barriers, to secure military and public facilities or also for border security. In addition, such barriers can be erected very rapidly, for example, when there is a hazard of storm surges and hurricanes, with comparatively low cost and characteristically higher resistance to the occurring storms in comparison with ordinary sandbag barriers. It is also possible to secure large construction sites from unauthorized access with barriers configured according to the invention.

Additional advantageous modifications and advantages of the invention are apparent from the accompanying description, drawing and claims.

In a preferred embodiment or version of the inventive barrier, it is additionally disclosed to form the barrier from several support elements and pile planks arranged between them. Corresponding double T-supports (I-Beam shaped) or tube piles are suitable as support elements for this purpose and which prevent the falling down of the barrier formed from the support elements and pile planks due to their high weight alone.

Connection elements or connection profiles are used to connect the support elements to the pile planks, which are mounted, on the one hand, on the top cross-leg of the T-profile of a double T-support and are provided with a lock profile for suspending and locking the pile plank, on the other. Such connection elements are offered by the applicant in different versions, for example, for connection of Peiner supports to so-called Larssen pile planks, Hoesch pile planks, Unions planks and also flat profiles.

It is also proposed in a preferred variant of the barrier according to the invention to connect two pile planks and/or support elements arranged right next to each other with connection elements. The connection elements are then formed so that the pile planks and/or support elements run at a stipulated trend relative to each other, when viewed in cross section. Right angles, angle trends of 30° of the pile planks or support elements relative to each other can be achieved with such connection elements. It is also possible to connect three or optionally even four sheet pile components with each other with such connection elements. Such connection elements or connection profiles are also offered by the applicant for different pile plank types.

A particular advantage for the durability of the barrier according to the invention is if the barrier is formed from two sheet-pile components arranged next to each other in two rows, the rows being connected to each other in sections by additional sheet-pile components serving as cross struts. For example, it is proposed to arrange several double T-supports next to each other. A pile plank is then suspended on the two long edges of each "T" of the double T-support, for example, by using a connection profile. Additional pile planks are suspended on the longitudinal edge of these pile planks so that a sheet-pile section is produced, which is finally suspended again in corresponding fashion on a double T-support arranged adjacent to it. Two sheet-pile sections running parallel to each other formed from pile planks are produced by this, which are supported relative to each other via the double T-support so that falling down of the barrier is effectively prevented.

It is also of particular advantage in this variant, if the intermediate space between the two rows of sheet-pile components is at least partially filled with a filling material. Soil is preferably suited as filling material, which is filled into the intermediate spaces by means of appropriate equipment, for example, an excavator. If the barrier is to be removed, only the individual sheet-pile components need be removed and the filler material left behind. If, on the other hand, the barrier is to remain erected longer, it is also possible to introduce concrete to the intermediate spaces as filler. In this case it is also possible to excavate the ground between the sheet-pile components to a stipulated depth and fill up both the excavated area and the intermediate area with concrete so that the barrier is secured in the ground. A plastic foam, for example, a polyurethane (PU) foam with which the intermediate spaces are at least partially filled is also suitable as filler material.

It is also an aspect of the invention to secure the barrier against shifting in the ground. For this purpose at least some of the sheet-pile components are anchored in the ground.

For anchoring in a modification of this variant, it is proposed that the sheet-pile components be partially rammed into the ground. In this case the ratio of height/length rammed into the ground and height/length protruding from the ground of the sheet-pile components anchored in the ground is preferably 1:4 to 1:6. The barrier is secured from displacement and optionally also falling down by the sheet-pile components rammed into the ground. Normal pile planks are rammed to ⅔ of their length into the ground in order to secure them from falling down.

If the barrier is either to be erected again at the same location or for a longer period, it is also proposed that at least some of the sheet-pile components anchored in the ground be secured, for example, by concreting.

Support elements, for example, double T-supports and/or tube piles are preferably used as sheet-pile components anchored in the ground since the barrier is supported, in particular, because of their cross-sectional shapes by these sheet-pile components. However, generally it is also possible to anchor pile planks in the ground in order to suspend additional sheet-pile components on the pile planks anchored in the ground. For example, this is particularly suitable, if, in order to secure river banks or in harbors, corresponding sheet pile structures secure the bank area and additional barriers are supposed to secure sections lying behind the bank edge, for example, during hurricanes. In this case it is then very simply possible to suspend the individual sheet-pile components in the pile planks anchored in the bank area at a break in the bank and thus quickly erect corresponding protective barriers without high expense.

It is also proposed to sink receptacles in the ground, for example, receiving shafts or receiving tube piles, in which the sheet pile components are introduced for anchoring. This design of the barrier is advantageous, for example, when the barriers are to be quickly erected but also quickly disassembled again. This variant is particularly suitable for protection of cities from flooding, in which the sheet pile components for anchoring are only introduced to the receptacles and the additional sheet-pile components must then be suspended to erect the barrier.

It is also proposed to connect the sheet pile components directly to buildings, on which appropriate connection profiles are provided, into which the sheet-pile components can be suspended.

Cold-rolled pile planks are preferably used to erect the barriers, since these have limited weight, on the one hand, in comparison with hot-rolled pile planks and, on the other hand, have sufficient stability in order to be used in the manner just outlined according to the invention. The cold-rolled pile planks are preferably provided with so-called ball-and-socket joints.

BRIEF DESCRIPTION OF THE DRAWINGS

The invention is further explained below by means of three practical examples with reference to the accompanying drawings in which.

DETAILED DESCRIPTION

Figure 1:
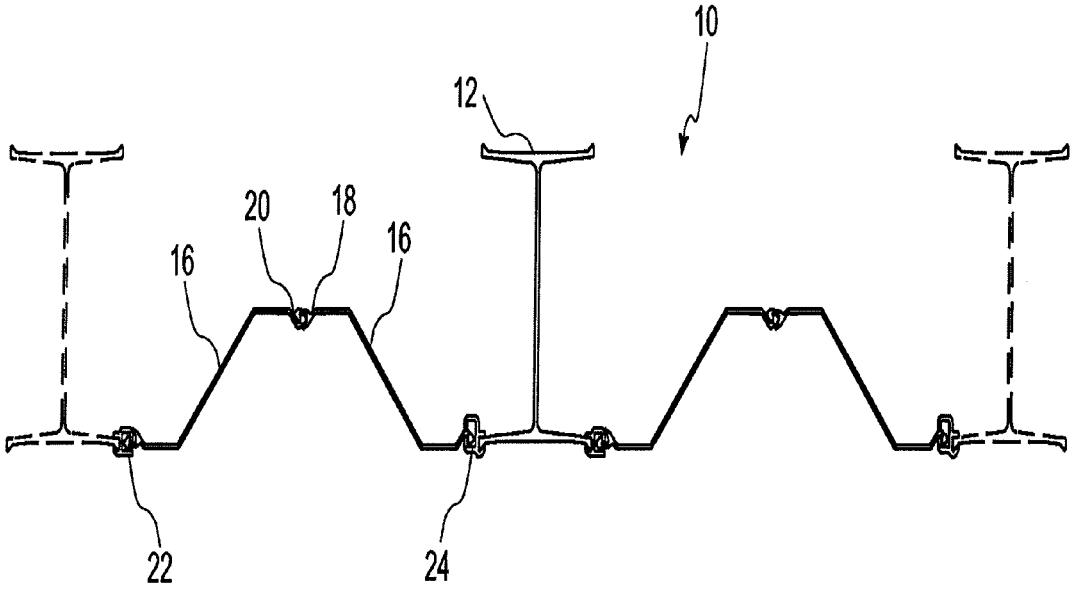
FIG. 1 shows a top view of a first variant of a barrier according to the invention.

A top view of a first practical example of a barrier 10 according to the invention is shown in FIG. 1. The barrier 10 consists of several Peiner supports 12 arranged next to each other in a row with a length of about three meters. The Peiner supports 12 rest with one of their ends on the ground 14 without being driven or rammed into the ground 14.

Two Z-pile planks 16, which are raised upward in a longitudinal direction vertically from ground 14, are arranged between two Peiner supports 12 arranged next to each other. The two Z-pile planks 16 arranged between the two Peiner supports 12 are connected to each other on their facing longitudinal edges by lock profiles 18 and 20. The lock profiles 18 and 20 of the two Z-pile planks 16 facing away from each other are suspended in the connection profiles 22 and 24, which in turn are pushed onto the longitudinal edges of the Peiner supports 12 that widen wedge-like and are secured to them.

Additional Z-pile planks 16 are correspondingly connected by connection elements 22 and 24 to the other adjacent Peiner supports 12 so that barrier 10 is formed.

It should be noted that the barrier 10 stands essentially freely, since the individual sheet pile components of barrier 10, namely in the Peiner supports 12, the Z-pile planks 16 as well as the connection elements 22 and 24 are not driven into the ground 14. The barrier 10 instead stands because of the intrinsic weight of the different sheet pile components of barrier 10 and their trend relative to each other.

In order to additionally secure barrier 10 against displacement or possibly also falling down, it is further proposed to drive some of the sheet pile components, for example, some of the Peiner supports 12 to a certain extent additionally into ground 14 and anchor them in the ground.

Figure 2:
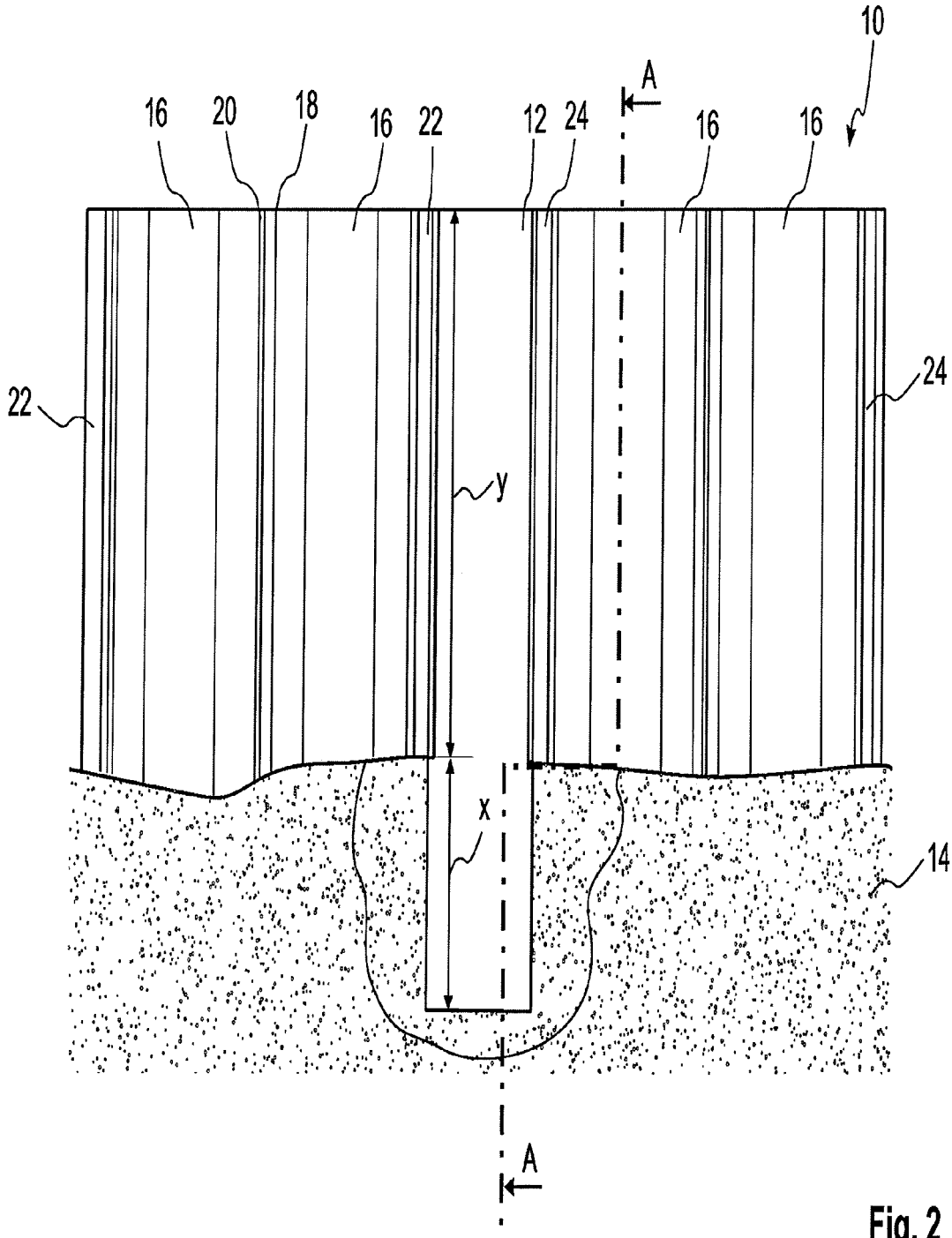
FIG. 2 shows a front view of the barrier depicted in FIG. 1.
Figure 3:
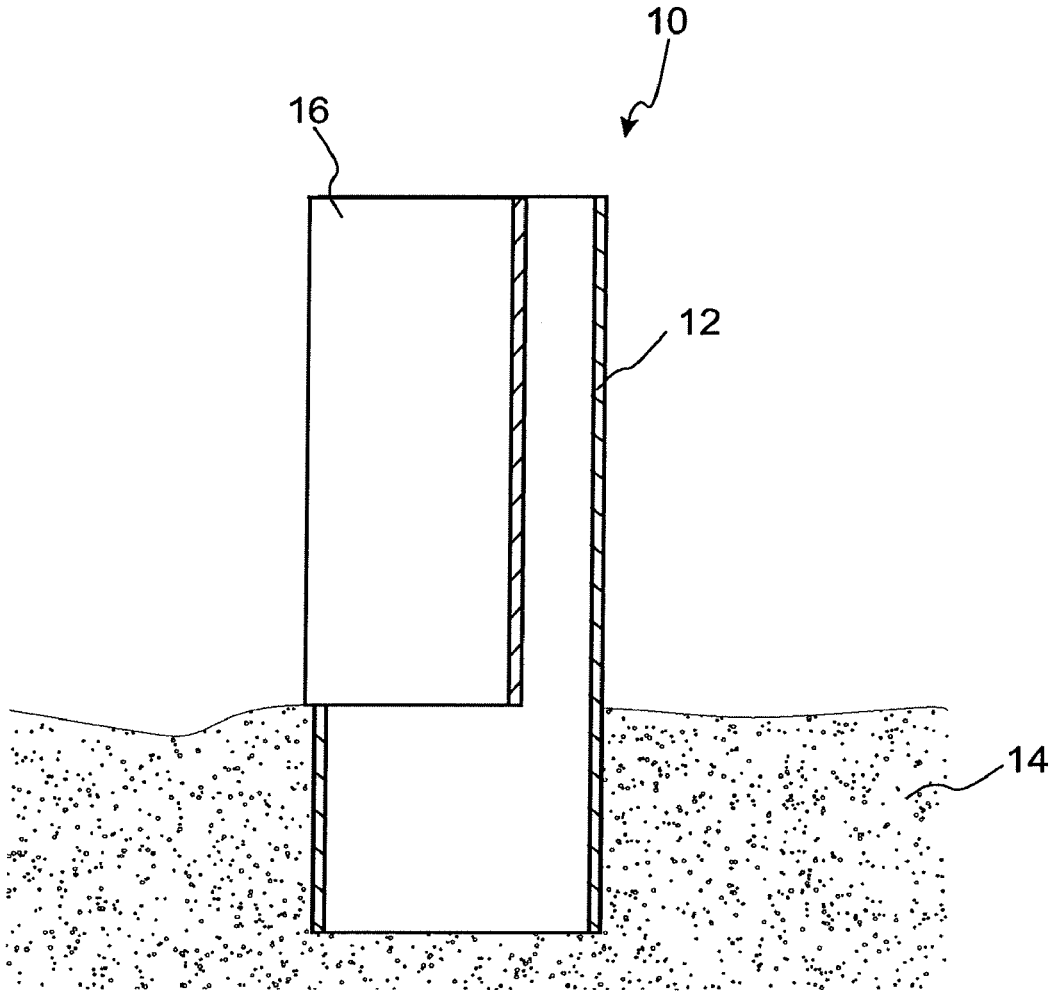
FIG. 3 shows a sectional view along section A-A of the barrier depicted in FIG. 2.

A modified variant of the barrier 10 depicted in FIG. 1 is shown in FIG. 2 in which one of the Peiner supports 12 is rammed into the ground for a stipulated length "X" in order to secure barrier 10 from displacement and falling down. In order to secure it, it is sufficient if the ratio of the length x of the Peiner support 12 rammed into the ground to the length y of the Peiner support 12 protruding from the ground lies in a range from 1:4 to 1:6, as shown, in particular, in FIG. 3, in which a section along section A-A of the modified practical example depicted in FIG. 2 is shown.

Figure 4:
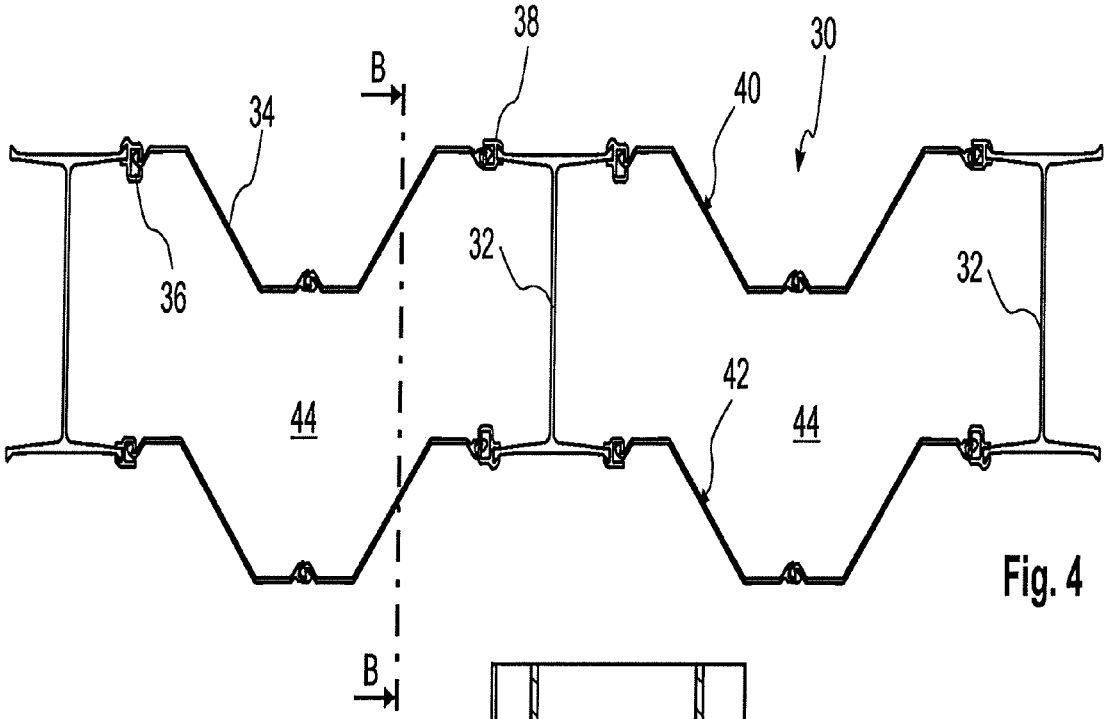
FIG. 4 shows a top view of second variant of a barrier according to the invention formed from two sheet-pile sections.

A second practical example of a barrier 30 is shown in FIG. 4. Here again, barrier 30 is formed from Peiner supports 32 that are arranged at a spacing from each other and positioned on the ground 14. Z-pile planks 34, which are connected both to each other and the Peiner supports 32 via connection elements 34 and 36, are also arranged between the Peiner supports 12.

In the second practical example, however, a second row of Z-pile planks 16 is provided, which are likewise coupled to the Peiner supports 12, but in this case to the rear T-sections of the Peiner supports 12. In this way two rows 40 and 42 are obtained from the Z-pile planks 34 connected to each other, an intermediate space 44 being obtained between the rows 40 and 42 and the Peiner supports 32.

Figure 5:
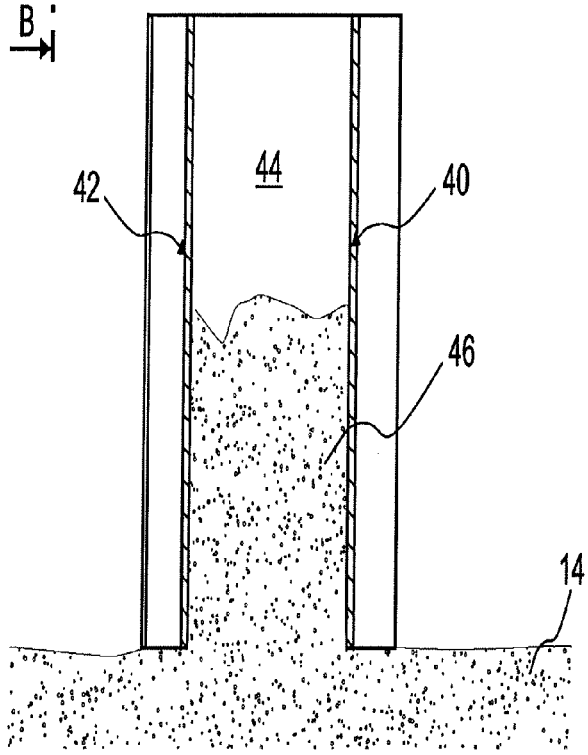
FIG. 5 shows a sectional view along section B-B of the barrier depicted in FIG. 4.

As also shown in FIG. 5, in which a sectional view along section B-B of the barrier 30 depicted in FIG. 4 is shown, the intermediate spaces 44 between the two rows 40 and 42 and the Peiner supports 32 are each filled with earth 46 in order to give barrier 30 additional stability.

This type of barrier 30 is suitable, for example, for military purposes, in order to erect street barriers or to protect military or public facilities. Here again the barrier 30 can be erected very quickly and also disassembled again, if necessary.

If the barrier 30 is to remain erected over a longer period, it is also possible instead of filling the intermediate spaces with earth 46, to fill the intermediate spaces with concrete. In this case it is also particularly advantageous, if the individual sheet-pile components are provided on the inside with a corresponding coating in order to facilitate loosening of the sheet-pile components from the hardened concrete at a later time.

Figure 6:
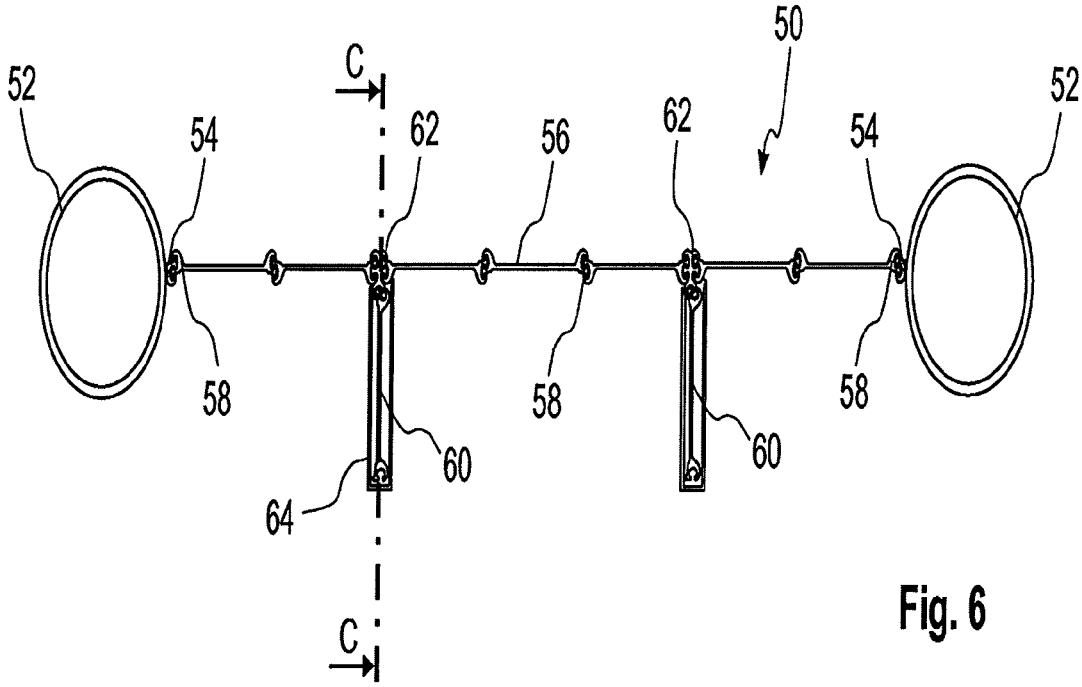
FIG. 6 shows a top view of a third variant of a barrier according to the invention with tube piles anchored in the ground and pile planks introduced to receptacles.
Figure 7:
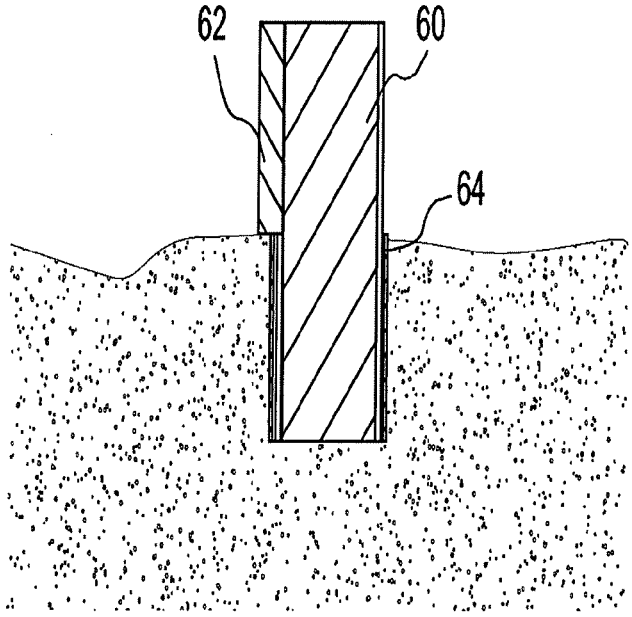
FIG. 7 shows a sectional view along section C-C of the barrier depicted in FIG. 6.

A third practical example of a barrier 50 is shown in FIGS. 6 and 7. In this case the barrier 50, however, is designed so that it can be erected quickly and also disassembled again, if necessary. Such a barrier is suitable, for example, for protection of city areas and villages during floods.

The barrier 50 according to the invention in this case consists of several tube piles 52 driven into the ground, in FIG. 6 shown on the ends of barrier 50, which are not removed. Welded-on profiles 54 are welded onto the sections of tube piles 52 protruding from ground 14, which serve for connection of so-called Union profiles 56 (also called flat profiles). These are flat pile planks, which are designed on the ends with identical locks 58. The Union profiles 56 are suspended one in the other with their locks 58 and thus form the actual barrier 50, in which the Union profiles 56 are not driven into the ground 14 either.

In order to support the Union profiles 56 suspended one in the other in the middle sections as well, additional Union profiles 60 are provided, which relative to the longitudinal direction of barrier 50 run at an angle of about 90 degrees relative to the longitudinal direction of barrier 50. The Union profiles 60 are coupled to the additional Union profiles 56 by connection element 62, connection element 60 permitting coupling of three Union profiles 56 and 60.

In order to secure barrier 50 in the depicted arrangement, the Union profiles 60 running at an angle of 90 degrees to the longitudinal direction of barrier 50 are made longer than the other Union profiles 56. In order to secure barrier 50 these longer Union profiles 60 are introduced to shaft 64 sunk in ground 14, in which the Union profiles 60 are accommodated with limited play. The connection profile 62, on the other hand, are supported on the ground 14 like the other Union profiles 56, which are coupled by the connection profile 62 to the Union profiles 60 assigned to them.

If the depicted barrier 50 is to be erected, for example, during a hazard of flood, only the coverings need be removed from the shafts 64, the Union profile 60 introduced and the additional Union profiles 56 then suspended in the welded-on profiles 54 and connection profile 62. The individual locks 58 of the engaged sheet pile components are then sealed with an appropriate sealing material, for example, the product "Wadit®" marketed by the applicant, in order to prevent penetration of water. In addition, it is also possible to provide corresponding sealing element, for example in the form of elastic sealing lips or sealing elements in the area of the barrier 50, especially at the locations at which the Union profiles 56 sit on ground 14.

Alternatively, the present invention may be described as a substantially free standing, above-ground barrier wall 10 that includes several (a plurality of) sheet-pile planks 16, and optionally one or more support elements 12 that are connected together using interlocking connectors 22, 24. The sheet-pile plank 16 has a lower edge located proximate a top surface of the ground 14 upon which the free standing above-ground barrier wall 10 is erected in an upstanding, installed configuration as illustrated in the several figures. The barrier gets its free-standing capability at least in part from the fact that the wall is not generally linearly configured and has sufficiently two dimensional characteristics at the ground engaging base to keep the wall in an upstanding configuration, even without outside support.

In the optional configuration constituted by sheet-pile plank(s) 16 and support element(s) 12, each constitutes a sheet-pile component and in the upstanding, installed configuration, a lower portion of the sheet-pile plank 16 is ground engaged and a substantial entirety of the weight of the sheet-pile plank is supported at its engagement with the ground. The engagement may be merely abutting with the plank 16 resting atop the ground, or the lower edge of the plank 16 may be buried into the ground to a certain degree.

The sheet-pile plank 16 and the support element 12 are each upstanding in the installed configuration and a lower portion of at least one of the sheet-pile components is buried underground as depicted in FIG. 2. In one advantageous embodiment, the buried lower portion constitutes less than about fifteen percent of an average height of the sheet-pile component. In another advantageous embodiment, the buried lower portion constitutes less than about twenty percent of an average height of the sheet-pile component. When standing or turbulent water is required to be contained, such as when the barrier wall is used to repel a storm surge, the greater depth of about twenty percent is preferred. In the example of FIG. 2, it is the support element 12 that is shown to be buried in the ground 14 to a greater extent.

Referring again to FIG. 2, the utilization of the interlocking connectors 22, 24 is depicted and demonstrates that each is an independent elongate element that is lengthwise upstandingly oriented in the installed configuration and couple a sheet-pile plank 16 to an adjacent support element 12.

FIGS. 4 and 5 show the barrier wall to include two adjacently positioned sidewalls 40, 42, each of which has a lengthwise axis (horizontally oriented in FIG. 4) that is oriented substantially parallel to the other and each of the sidewalls 40, 42 comprises a plurality of sheet-pile planks interconnected with at least one support element and each sheet-pile plank has a lower edge located proximate the top surface of the ground upon which the barrier wall is erected. The two adjacently positioned sidewalls 40, 42 are spaced apart, one from the other, with a fillable space 44 therebetween. Suitable filler material includes soil, concrete and plastic foam. As shown in FIG. 4, the two adjacently positioned sidewalls 40, 42 are interconnected by an I-beam 32 that constitutes a support element of the barrier wall and the two sidewalls are spaced apart, one from the other, at a distance approximately equal to a length of the I-beam's web extending therebetween.

The practical examples depicted in the figures represent only some of the possibilities of erecting a barrier according to the invention. For example, it is possible to form closed barrier 50, for example, by sheet-pile sections arranged intersecting or rectangular from pile plants that are coupled to each other based on their intrinsic weight and the arrangement is free-standing without ramming the individual sheet-pile components into the ground as is otherwise common. It is also possible to additionally secure the engaged sheet-pile components, for example, by welded connections in order to prevent unintended loosening of the sheet-pile components from each other.

The invention claimed is:

1. A method of erecting a free-standing, above-ground, barrier wall that comprises a plurality of sheet-pile components interconnected with each other by interlocks, said method comprising the steps of interconnecting and positioning said sheet-pile components relative to one another such that the wall is self supporting and freestanding, and erected in an upstanding, installed configuration, while a majority of the sheet-pile components exclusively engage a top surface of the ground upon which said free standing, above-ground wall is erected at a lower edge thereof and thereby establish the upstanding, installed configuration of said wall;

wherein said step of interconnecting comprises interconnecting a plurality of sheet-pile planks in series with a plurality of support elements by a plurality of interlocking connectors;

wherein said step of positioning comprises engaging a lower portion of at least one of said sheet-pile planks with the ground with a lower edge thereof located proximate a top surface of the ground upon which said free standing above-ground barrier wall is erected in an upstanding, installed configuration; and wherein, when erected in such upstanding, installed configuration, said lower edge of said at least one sheet-pile plank is ground engaged and at least part of the weight of such sheet-pile plank is supported at the engagement between the sheet-pile plank and the ground, and at least some of said plurality of interlocking connectors are independent elongate elements that are lengthwise upstandingly oriented and couple a sheet-pile plank to an adjacent support element.

2. The method of erecting a barrier wall as recited in claim 1, wherein two of said sheet-pile components are adjacently interconnected with respective lengthwise axes thereof oriented at one of 30 degrees, 45 degrees and 90 degrees relative one another.

3. The method of erecting a barrier wall as recited in claim 1, wherein said barrier wall comprises two adjacently positioned sidewalls, each of which has a lengthwise axis that is oriented substantially parallel to the other and each of said sidewalls comprises as sheet-pile components a plurality of sheet-pile planks interconnected with at least one support element and each sheet-pile plank has a lower edge located proximate the top surface of the ground upon which the barrier wall is erected.

4. The method of erecting a barrier wall as recited in claim 3, wherein said two adjacently positioned sidewalls are spaced apart, one from the other, with a fillable space therebetween.

5. The method of erecting a barrier wall as recited in claim 4, wherein said fillable space between said two adjacently positioned sidewalls is filled with a filler material.

6. The method of erecting a barrier wall as recited in claim 5, wherein said filler material is one of soil, concrete and plastic foam.

7. The method of erecting a barrier wall as recited in claim 4, wherein said two adjacently positioned sidewalls are interconnected by an I-beam that constitutes a support element of the barrier wall and said two sidewalls are spaced apart, one from the other, at a distance approximately equal to a length of the I-beam's web extending therebetween.

8. The method of erecting a barrier wall as recited in claim 1, further comprising the step of anchoring a lower portion of at least one of said sheet-pile components proximate ground level against lateral movement in the installed configuration.

9. The method of erecting a barrier wall as recited in claim 8, wherein said anchoring step includes anchoring the lower portion of said at least one sheet-pile component in concrete in the installed configuration.

10. The method of erecting a barrier wall as recited in claim 8, wherein said anchoring step includes anchoring the lower portion of said at least one sheet-pile component in a receptacle that is recessed into the ground.

11. The method of erecting a barrier wall as recited in claim 1, further comprising the step of securing an end of said barrier wall to a building at an interlocking connector located on the building.

12. The method of erecting a barrier wall as recited in claim 1, wherein some of the sheet-pile components are cold-rolled.

13. The method of erecting a barrier wall as recited in claim 12, wherein some of the sheet-pile components are interconnected by ball-and-socket joints.

14. A method of erecting a free-standing, above-ground, barrier wall that comprises a plurality of sheet-pile components interconnected with each other by interlocks, said method comprising the steps of interconnecting and positioning said sheet-pile components relative to one another such that the wall is self supporting and freestanding, and erected in an upstanding, installed configuration, while a majority of the sheet-pile components exclusively engage a top surface of the ground upon which said free standing, above-ground wall is erected at a lower edge thereof and thereby establish the upstanding, installed configuration of said wall; wherein at least one of the sheet-pile components is one of an upstanding I-beam and an upstanding tubular pipe.

15. The method of erecting a barrier wall as recited in claim 14, further comprising the step of anchoring a lower portion of at least one of said sheet-pile components proximate ground level against lateral movement in the installed configuration.

16. The method of erecting a barrier wall as recited in claim 15, wherein said anchoring step includes anchoring the lower portion of said at least one sheet-pile component in concrete in the installed configuration.

17. The method of erecting a barrier wall as recited in claim 15, wherein said anchoring step includes anchoring the lower portion of said at least one sheet-pile component in a receptacle that is recessed into the ground.

18. A method of erecting a free-standing, above-ground, barrier wall that comprises a plurality of sheet-pile components interconnected with each other by interlocks, said method comprising the steps of interconnecting and positioning said sheet-pile components relative to one another such that the wall is self supporting and freestanding, and erected in an upstanding, installed configuration, while a majority of the sheet-pile components exclusively engage a top surface of the ground upon which said freestanding, above-ground wall is erected at a lower edge thereof and thereby establish the upstanding, installed configuration of said wall, wherein some of the sheet-pile components are cold-rolled and some of the sheet-pile components are interconnected by ball-and-socket joints.

* * * * *